United States Patent [19]

Lyle, Jr.

[11] Patent Number: 5,010,292

[45] Date of Patent: Apr. 23, 1991

[54] VOLTAGE REGULATOR WITH REDUCED SEMICONDUCTOR POWER DISSIPATION

[75] Inventor: Robert L. Lyle, Jr., Knoxville, Tenn.

[73] Assignee: North American Philips Corporation, New York, N.Y.

[21] Appl. No.: 449,664

[22] Filed: Dec. 12, 1989

[51] Int. Cl.[5] ..... G05F 1/56

[52] U.S. Cl. ..... 323/274; 323/275; 323/280

[58] Field of Search ..... 323/273, 274, 275, 276, 323/277, 278, 279, 280, 281

[56] References Cited

U.S. PATENT DOCUMENTS

| | | | |
|---|---|---|---|
| 3,120,635 | 2/1964 | Tully, Jr. | 323/274 |
| 3,158,800 | 11/1964 | McPherson . | |
| 3,541,425 | 11/1970 | Weidmann | 323/273 |
| 3,684,924 | 8/1972 | Miller, Jr. | 323/273 |
| 3,906,310 | 9/1975 | Esashika | 323/273 |
| 4,374,356 | 2/1983 | Hashimoto | 323/273 |
| 4,731,574 | 3/1988 | Melbert | 323/275 |
| 4,792,747 | 12/1988 | Schroeder | 323/274 |

FOREIGN PATENT DOCUMENTS 1-32324 2/1989 Japan .

*Primary Examiner*—Peter S. Wong
*Attorney, Agent, or Firm*—Robert J. Kraus

[57] ABSTRACT

A series pass voltage regulator is provided which has reduced power dissipation in the semiconductor components of its output stage. The output stage includes first and second impedances which are electrically connected in parallel for collectively carrying a load current supplied at an output of the regulator. The first impedance comprises the series combination of a transistor collector-emitter output impedance and a resistor, while the second impedance comprises the series combination of a transistor collector-emitter output impedance and two diodes. The bases of the two transistors are coupled to the output of an error amplifier to effect control of the output impedances. In all high load current situations, the resistor dissipates more than 75% of the power dissipated in the output stage.

6 Claims, 11 Drawing Sheets

VOLTAGE REGULATOR WITH REDUCED SEMICONDUCTOR POWER DISSIPATION

BACKGROUND OF THE INVENTION

1. Field of the Invention

The invention relates to linear voltage regulators, and in particular to such regulators with series pass power semiconductor output stages.

2. Description of Related Art

In a linear voltage regulator with a series pass output stage, power dissipation in the output stage varies linearly with changes in current demands supplied to a load by the regulator and with the voltage drop in the output stage. In such a voltage regulator, the output stage includes a variable impedance connected in series with the load. Typically, this variable impedance comprises one or more semiconductor devices which must dissipate substantial power at high load currents. This necessitates the use of high power semiconductor devices mounted on large heat sinks. These heat sinks occupy space that could be better used and are often more expensive than the power semiconductors themselves.

To facilitate comparison of several output stage circuits, a typical specification for a television voltage regulator of the above described type will be utilized. This exemplary specification requires the capability of supplying to a load a regulated voltage of 123 VDC over a load current range of 0.21 amp to 0.78 amp from an unregulated input voltage $V_{in}$ which can vary from 130 VDC to 165 VDC. The power dissipation in the output stage of this linear voltage regulator at the maximum input voltage and maximum load current is approximately 33 watts. The semiconductor devices and heat sink(s) needed to dissipate this amount of energy would be commercially prohibitive.

FIG. 1*a* illustrates a known linear voltage regulator in which the power dissipated in the semiconductive impedance of the output stage (enclosed in the dashed line box) is reduced by incorporating a shunt resistor $R_s$ in the output stage. This shunt resistor is electrically connected in parallel with a power transistor Q10 of the output stage to reduce the percentage of load current $I_L$ which must pass through the output impedance of the transistor. The magnitude of this output impedance is controlled by well known control circuitry such as the feedback circuit illustrated in the figure. Briefly, this circuit includes an error amplifier Al having a first input to which a reference voltage $V_{ref}$ is supplied, a second input electrically connected to a node of a resistive divider circuit (R2,R4) for sensing the regulated output voltage $V_{out}$, and an output electrically connected to the base of transistor Q10 for controlling the output impedance of this transistor. The reference voltage $V_{ref}$ is supplied by a zener diode circuit (R1, $D_z$).

The currents passing through the shunt resistor and the transistor at different load currents are illustrated in FIG. 1*b*. To reduce power dissipation in the transistor, the current through the shunt resistor is made as large as possible within the operating limitations of the voltage regulator. In the illustrated circuit, however, the shunt current may not be made larger than the specified minimum load current of 0.21 amp, or the transistor will cut off above this load current and the output voltage $V_{out}$ will become unregulated. This output stage is not capable of regulating below 0.21 amp.

The power dissipated in the shunt resistor and the transistor over the specified load current range is illustrated in FIG. 1*c*. At the maximum input voltage (165 VDC) and maximum load current (0.78 amp) the shunt resistor dissipates only about 9 watts while the transistor dissipates about 24 watts. Thus, at maximum load the transistor dissipates over 70% of the power dissipated in the output stage. FIG. 2*a* illustrates a linear voltage regulator including in its output stage a shunt resistor $R_s'$ and first and second parallel transistor circuits comprising a first transistor / emitter resistor combination Q21 / R21 and a second transistor / emitter resistor combination Q22 / R22, respectively. This output stage functions similarly to that of FIG. 1*a*, except that the two transistors share the semiconductor power dissipation.

The currents passing through the shunt resistor and the two transistors at different magnitudes of load current $I_L$ are illustrated in FIG. 2*b*. As in the single transistor circuit arrangement of FIG. 1*a*, the current through the shunt resistor may not be made larger than the specified minimum load current of 0.21 amp, or the transistor will cut off above the minimum load current and the output voltage $V_{out}$ will become unregulated. Thus, this output stage is also incapable of operating as a regulator at load currents below 0.21 amp. The first transistor Q21 conducts current throughout the specified load current range, but the second transistor Q22 conducts current only above that value of load current at which the current through resistor R21 develops a voltage drop sufficient to forward bias the base-emitter junction of the second transistor.

The power dissipated in the shunt resistor and the two transistor circuits is illustrated in FIG. 2*c*. Note that at the maximum input voltage (165 VDC) and load current (0.78 amp) the shunt resistor still dissipates only about 9 watts, while the two transistor circuits collectively dissipate about 24 watts. The primary advantage of this output stage circuit arrangement over that of FIG. 1 is that each of the transistors and their respective heat sinks may have lower power dissipation ratings than that of the single transistor output stage. However, this offers no cost advantage over the single transistor arrangement.

SUMMARY OF THE INVENTION

It is an object of the invention to provide a linear voltage regulator having a series pass power output stage in which the power dissipated by a resistor is substantially greater than that dissipated in semiconductor components of the power output stage.

It is another object of the invention to provide such a linear voltage regulator in which the resistor does not limit the minimum load current at which the output voltage can be regulated by the output stage.

In accordance with the invention, a series pass linear voltage regulator of the above described type comprises first and second impedances for collectively carrying the load current from an input of the regulator at which an unregulated DC voltage is received to an output of the regulator at which the regulated DC voltage is supplied to a load. The first impedance comprises the series combination of a resistor and a first semiconductor device output impedance, which is electrically connected between the input and the output of the regulator. The first semiconductor device has an input for receiving a signal to effect variation of the device output impedance. The second impedance comprises a second semiconductor device output impedance, which is also electrically connected between the input and the output of the regulator. This second device also has an input for receiving a signal to effect variation of its output impedance. This input is electrically connected to conventional control circuitry, such as the feedback circuit already described, for receiving a control signal produced thereby.

This control signal is coupled to the input of the first semiconductor device by coupling means electrically connecting this input to the output impedance of the second semiconductor device. The control signal effects, in sequence, a gradual decrease in the first impedance from a high value to a low value, while the second impedance remains at a value which is much higher than the high value, as the load current increases to a predetermined magnitude. As the load current increases above the predetermined magnitude, the control signal effects a gradual decrease in the second impedance from the higher value. In this output stage circuit arrangement, the resistor dissipates an increasing percentage of the output stage power as the load current increases, and the power dissipation in the semiconductor devices is limited to relatively low values throughout the operating range of the regulator. Further, the first and second semiconductor devices never simultaneously dissipate significant amounts of power, because the second semiconductor device does not begin to dissipate significant power until the first semiconductor is operating at its minimum output impedance.

DESCRIPTION OF THE PREFERRED EMBODIMENTS

Figure 1A:
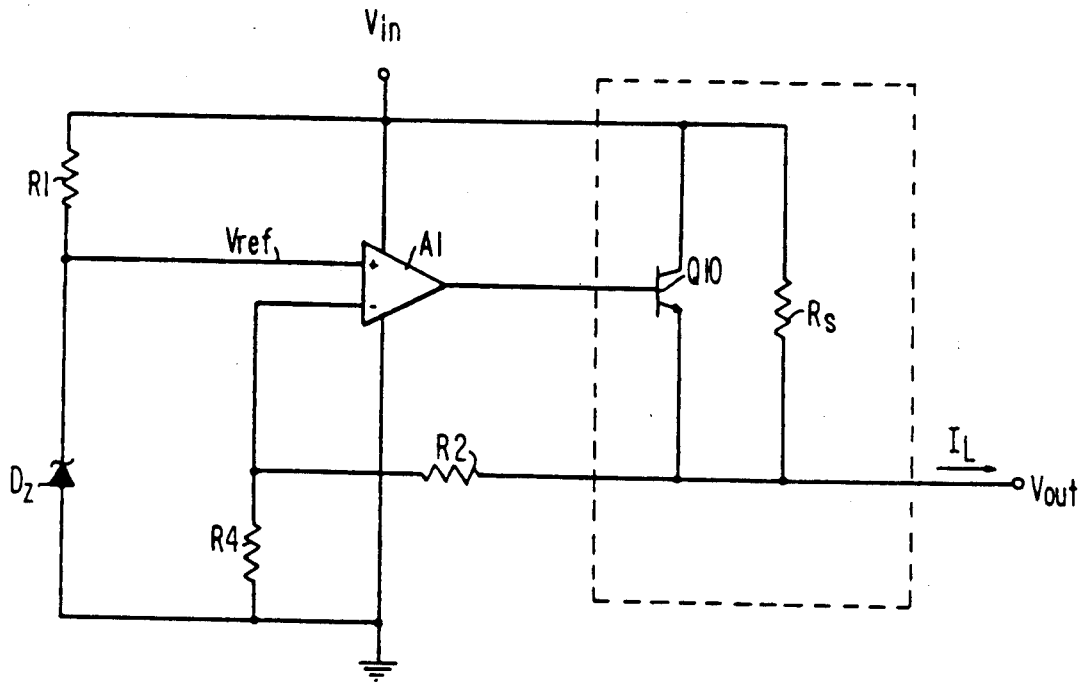
FIG. 1a PRIOR ART
FIGS. 1*a*, 1*b* and 1*c* illustrate the circuitry and operation of a first prior art series pass voltage regulator.
Figure 2A:
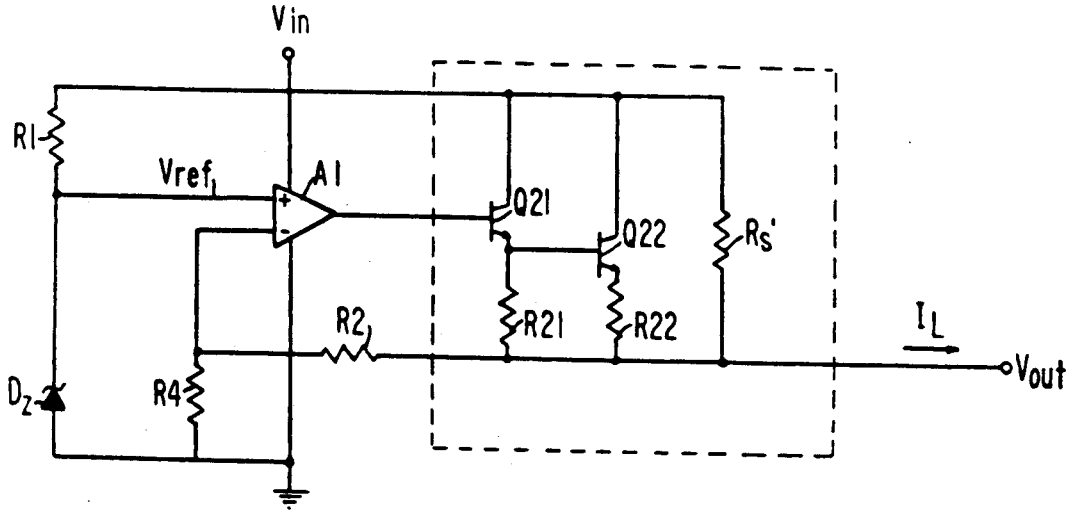
FIGS. 2*a*, 2*b* and 2*c* illustrate the circuitry and operation of a second prior art series pass voltage regulator.
Figure 1B:
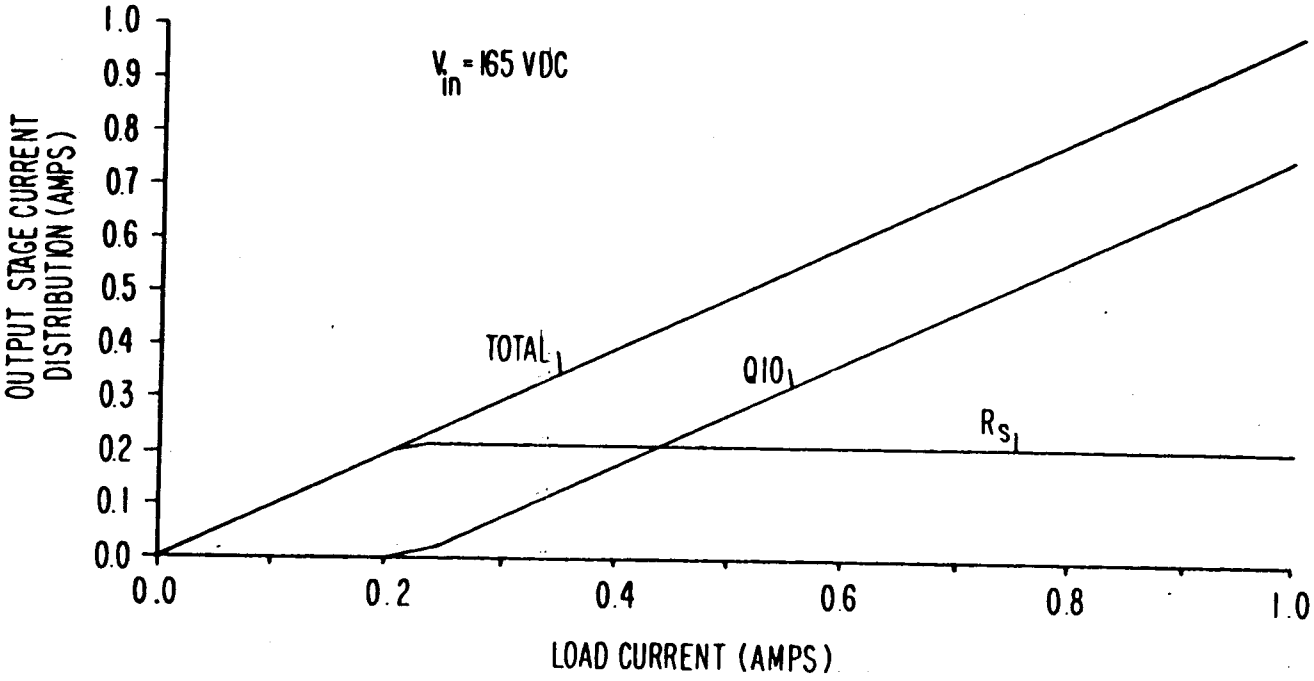
Figure 1C:
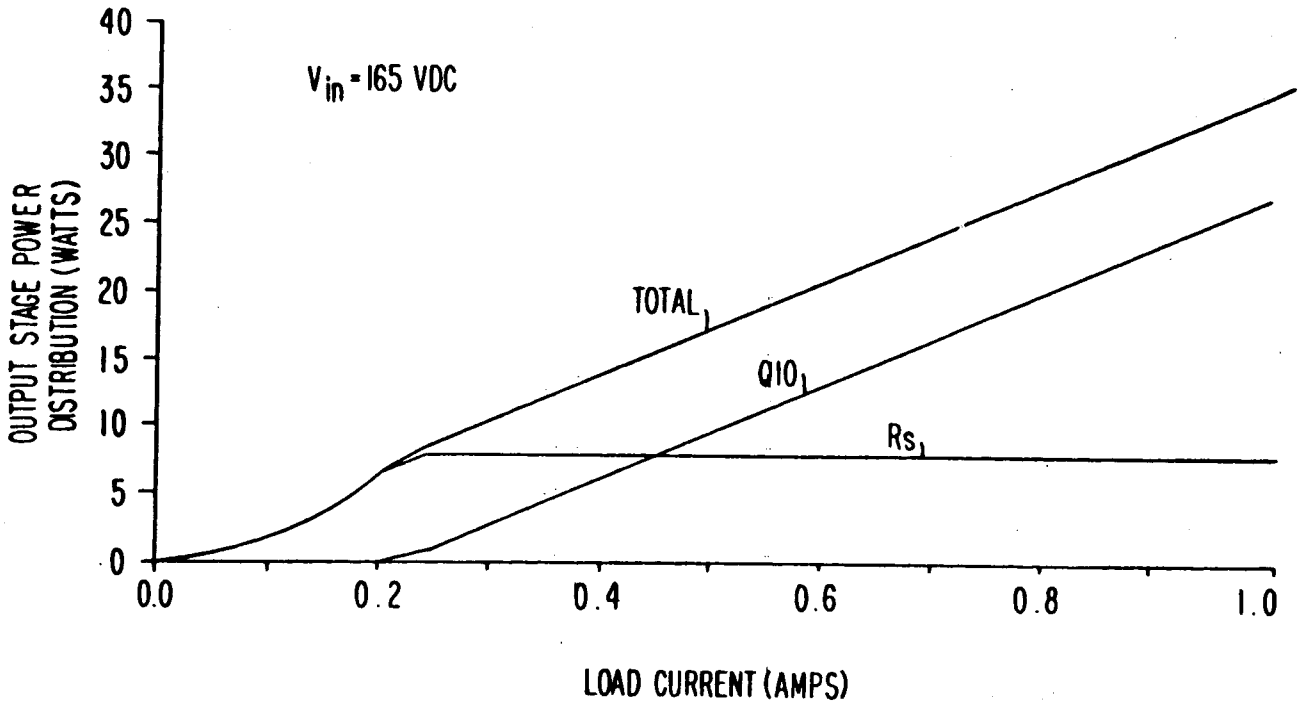
Figure 2B:
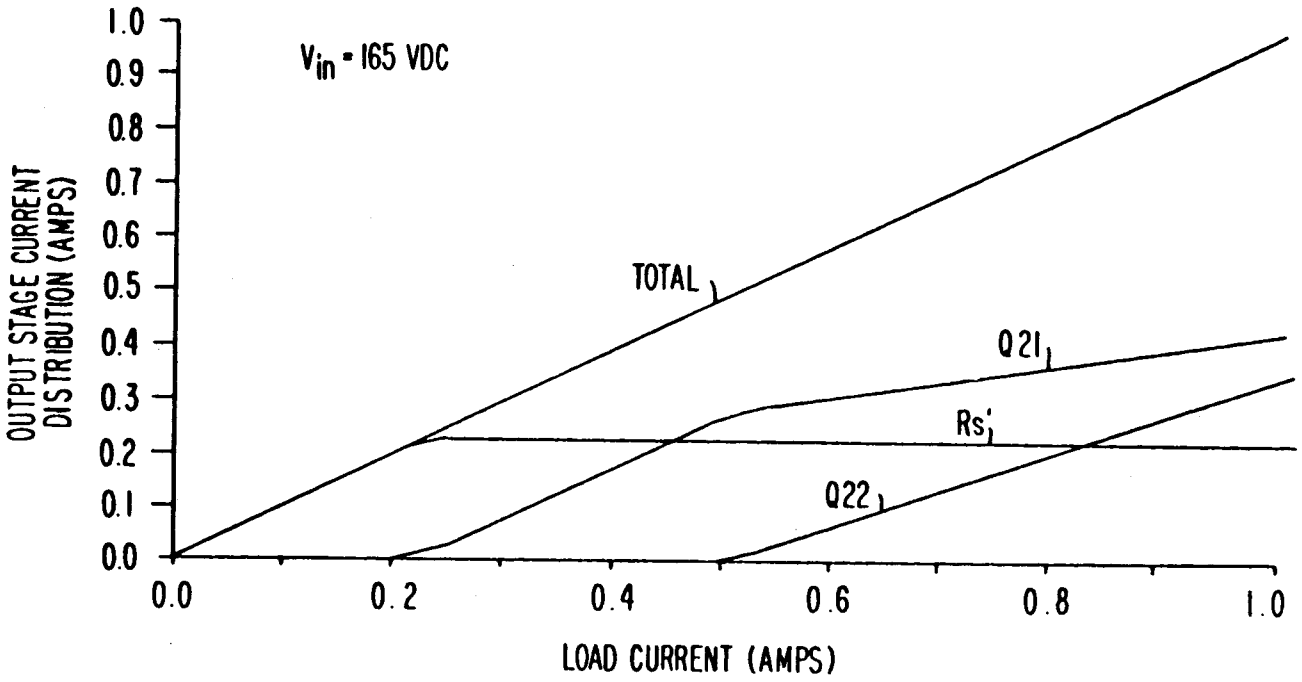
Figure 2C:
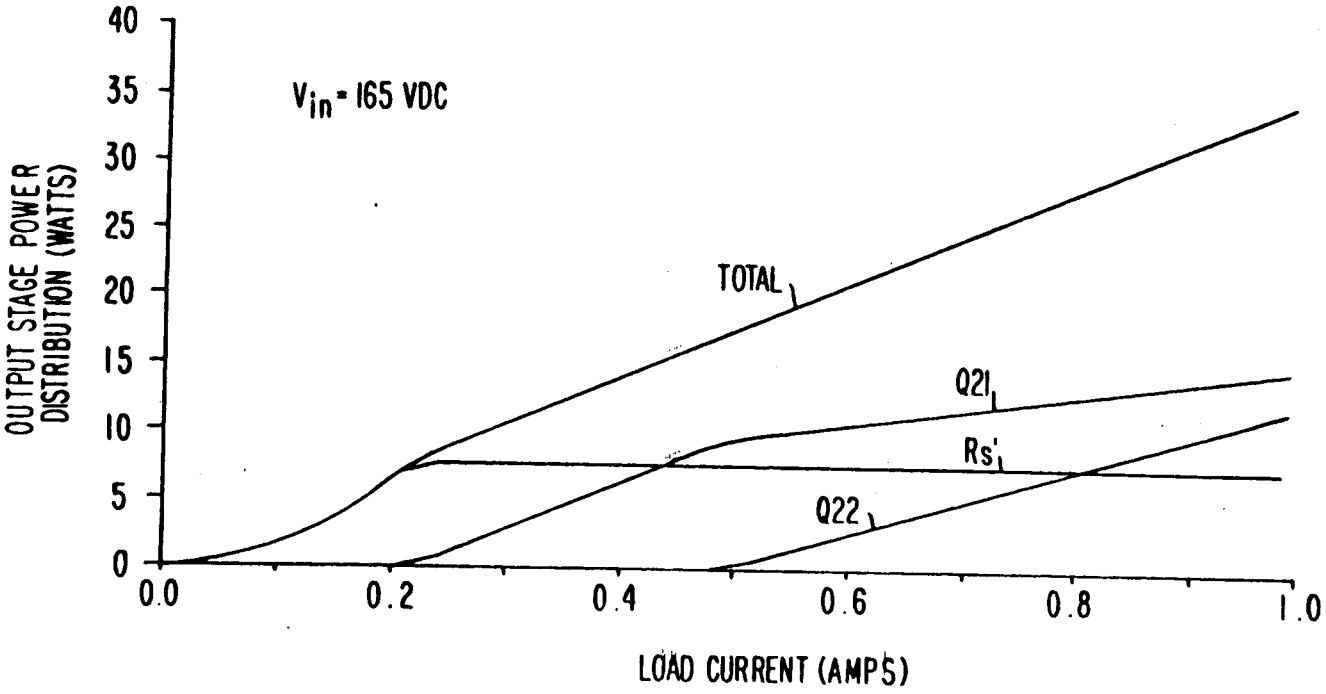
Figure 3A:
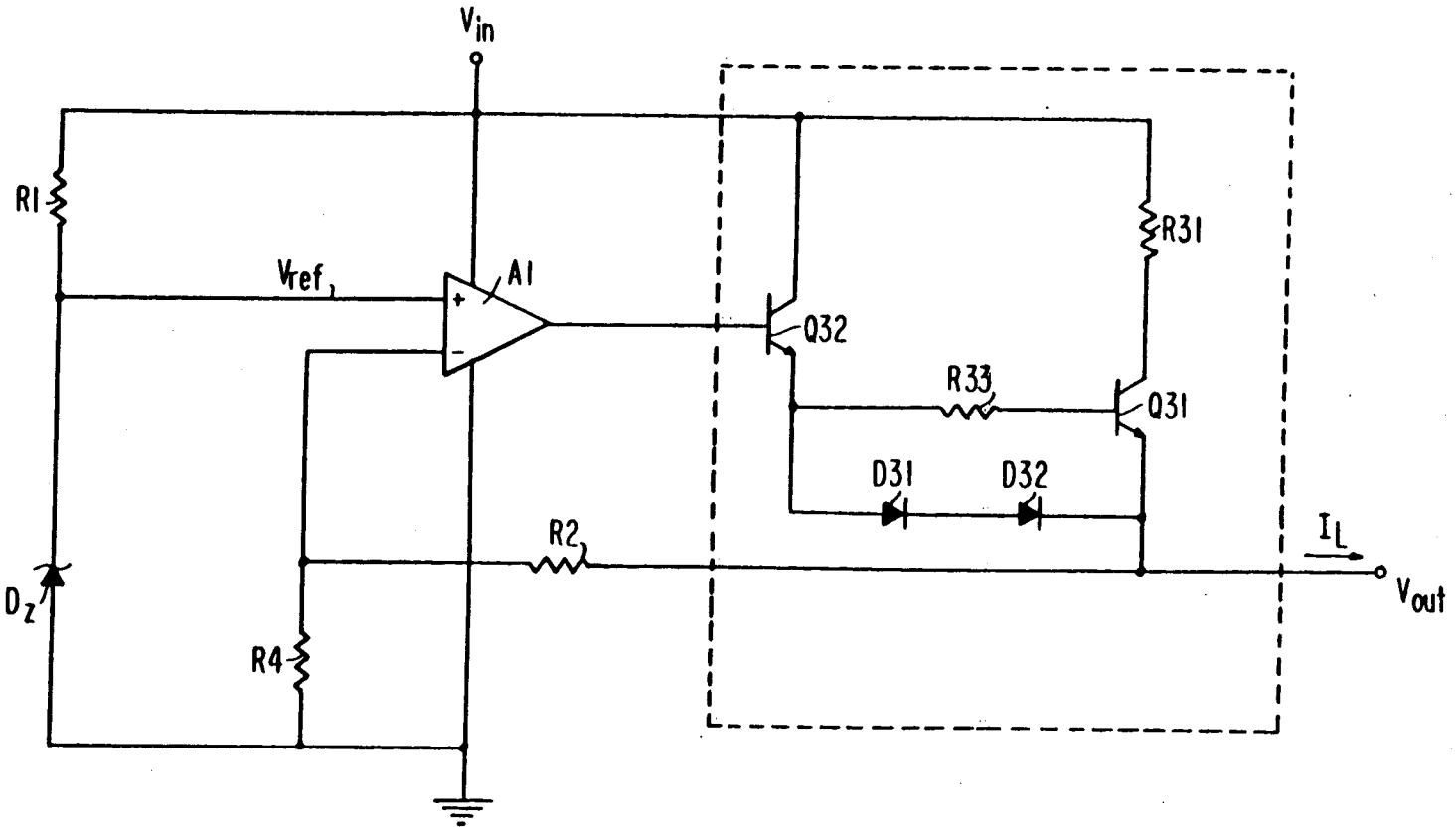
FIGS. 3*a*, 3*b*, 3*c*, 3*d* and 3*e* illustrate the circuitry and operation of an embodiment of series pass voltage regulator in accordance with the invention.

FIG. 3*a* illustrates a linear voltage regulator in which an embodiment of the output stage in accordance with the invention incorporates first and second NPN transistors as the first and second semiconductor devices.

The first transistor Q31 has an output impedance (measured between the collector and emitter of the transistor) which is in series with a resistor R31 connected to the collector of this transistor. This series combination, which forms the first impedance, is electrically connected between a first terminal at which the unregulated DC voltage $V_{in}$ is applied to the regulator and a second terminal at which the regulated DC voltage $V_{out}$ is supplied to a load.

The second transistor Q32 has an output impedance (measured between the collector and emitter of the transistor) which is in series with first and second diodes D31 and D32, respectively, connected to the emitter of this transistor. This series combination, which forms the second impedance, is electrically connected between the first and second terminals of the regulator in parallel with the first impedance. The diodes are not critically needed elements, but are provided as current limiting elements, as is subsequently described.

The base of transistor Q32 is electrically connected to the output of the error amplifier Al for receiving the control signal produced by this amplifier to maintain $V_{out}$ at the specified voltage. A resistor R33 is electrically connected between the emitter of the second transistor Q32 and the base of the first transistor Q31 for coupling the control signal to this base, which serves as the input of the first transistor. This resistor, in conjunction with diodes D31 and D32 limits the magnitude of the current flowing into the base of transistor Q31. The voltage across resistor R33 is substantially equal to that across diode D31, because the voltage across diode D32 is substantially equal to that across the base-emitter junction of transistor Q31.

Figure 3B:
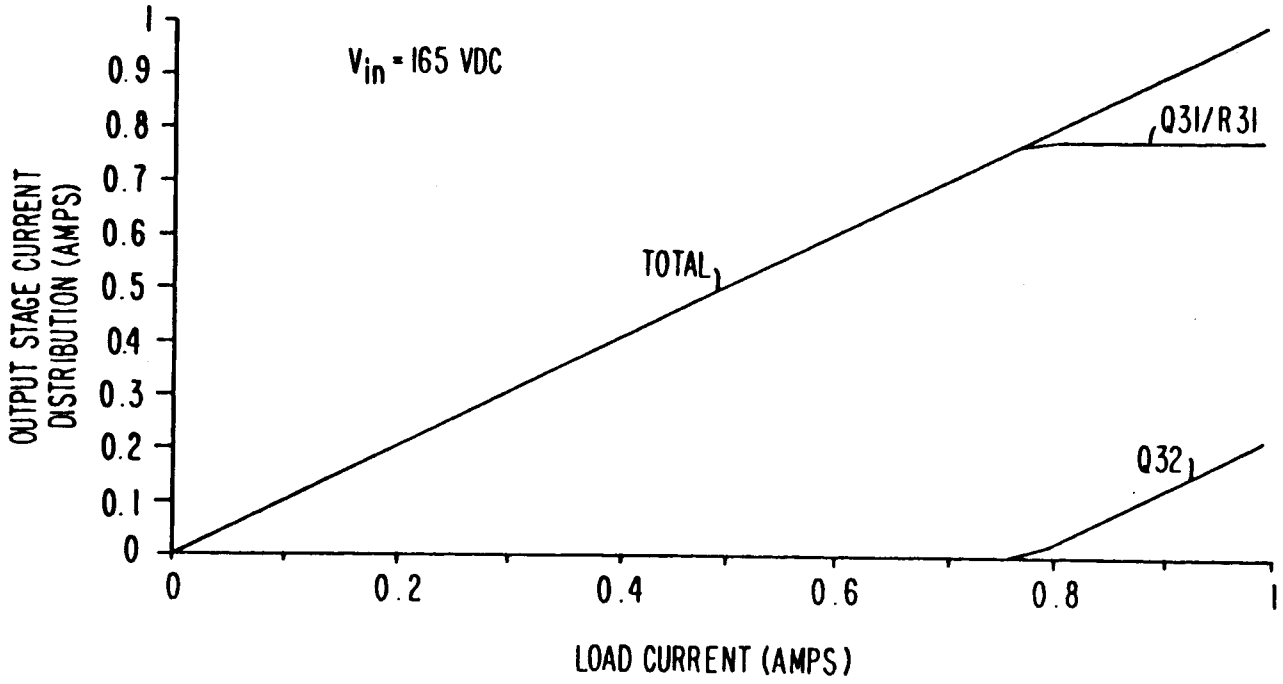

FIG. 3*b* illustrates the distribution of the load current $I_L$ between the output impedances of the transistors Q31 and Q32. At currents below the saturation level of transistor Q31, the output impedance of this transistor carries almost all of the load current. Transistor Q32 carries only sufficient current to drive the base of transistor Q31.

As this load current increases to the magnitude where the voltage drop across series resistor R31 approaches the difference $V_{in} - V_{out}'$ the output impedance of transistor Q31 decreases until this transistor saturates. At this point the output impedance of transistor Q32 begins to decrease and to carry substantial current. Load current exceeding the saturation current of transistor Q31 is carried by transistor Q32 and diodes D31 and D32.

Figure 3C:
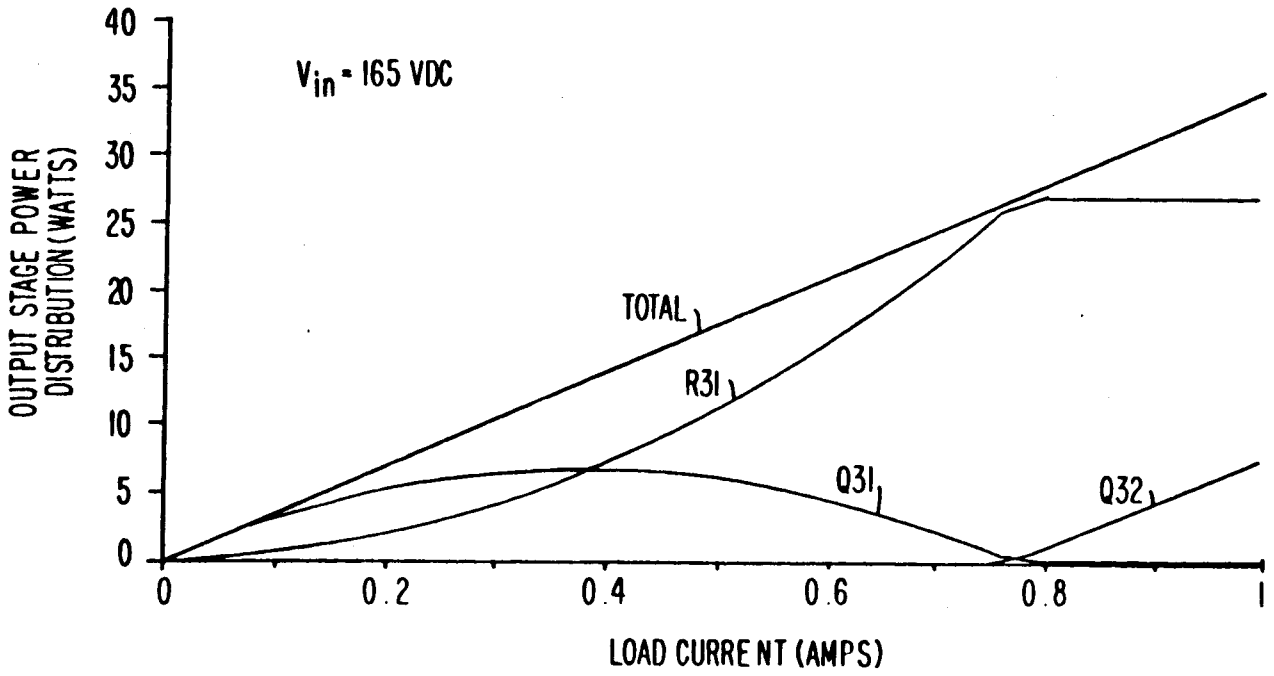

FIG. 3*c* illustrates the distribution of power dissipation among the transistors and the resistor R31, which dissipate most of the power dissipated by the regulator. At the specified maximum input voltage (165VDC) and maximum load current (0.78 amp) the resistor dissipates about 32 watts, while the transistors collectively dissipate only about 1 watt.

The maximum power dissipated by transistor Q31 occurs when the voltage difference between $V_{in}$ and $V_{out}$ is at the specified maximum (42 volts) and the load current $I_L$ is at one half of the specified maximum (0.39 amp). This occurs at the point in FIG. 3*c* where the power curves for R31 and Q31 cross. At this maximum dissipation voltage and current transistor Q31 dissipates only about 8 watts, which is about 25% of the maximum power dissipated by resistor R31 at the specified maximum input voltage and load current.

Transistor Q32 dissipates significant power only when the load current exceeds the saturation current of transistor Q31. The maximum power dissipated by transistor Q32 occurs when the load current is at its maximum value and when half of the load current is passed by transistor Q32. The voltage difference between $V_{in}$ and $V_{out}$ at which transistor Q32 dissipates maximum power depends on the value of resistance R31. The optimum value of this resistance is equal to $V_{in} - V_{out}/I_L(\max)$, where $I_L(\max)$ is the maximum specified load current. With the optimum value of the resistance R31, the maximum power dissipation in transistor Q32 is only about 8 watts, which is about 25% of the maximum power dissipated by resistor R31 at the specified maximum input voltage and load current.

Figure 3D:
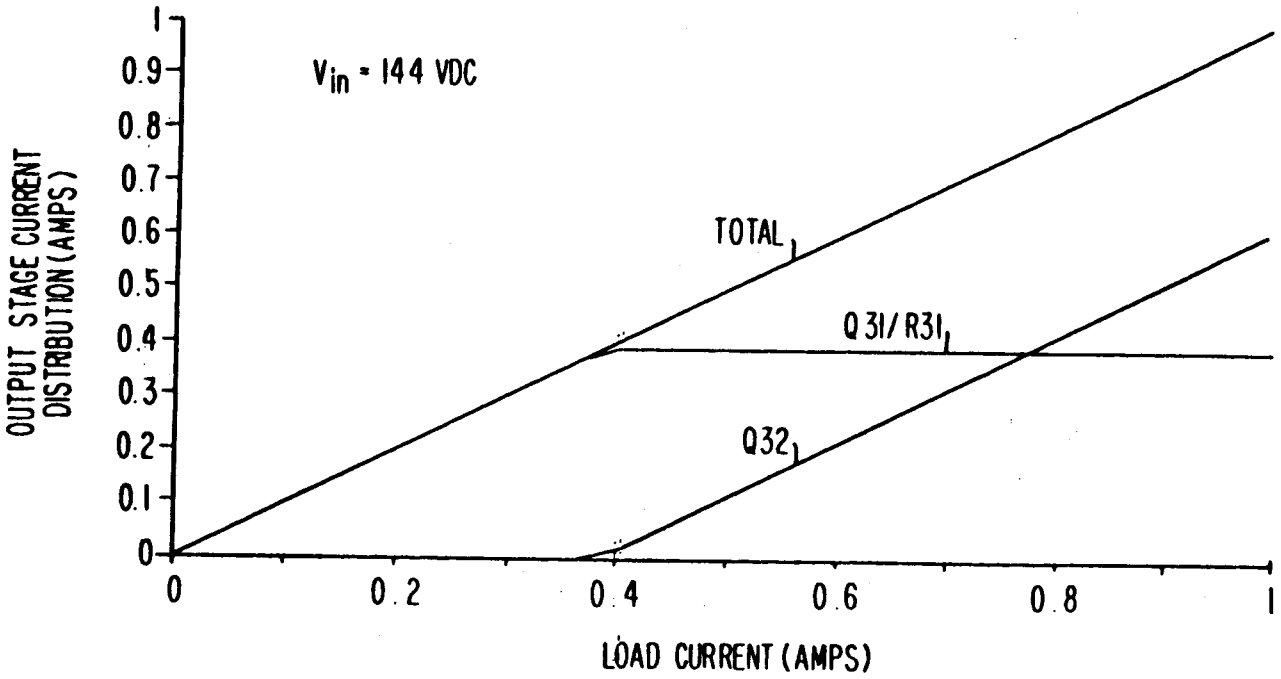

FIG. 3*d* illustrates the distribution of the load current $I_L$ between the output impedances of the transistors Q31 and Q32 under the input voltage condition at which maximum power is dissipated in transistor Q32, i.e.

where $V_{in}$ = 144 VDC. Under this condition, Q31 saturates at a lower current than when the regulator is operating at maximum input voltage.

Figure 3E:
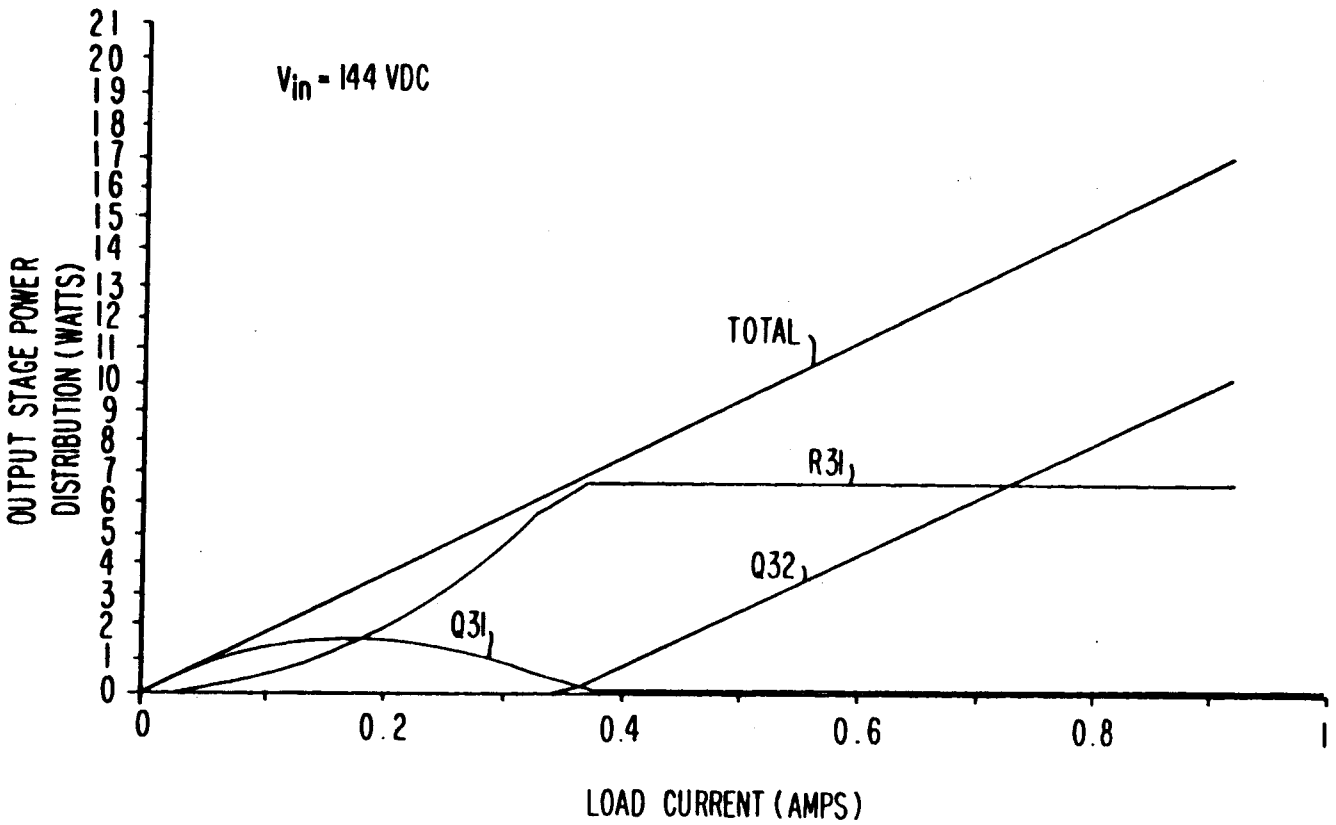

FIG. 3*e* illustrates the distribution of power dissipation among the transistors and the resistor R31 when $V_{in}$ = 144 VDC. At this lower input voltage condition, transistor Q32 dissipates more power than transistor Q31 does at high load currents. However, the maximum power dissipation in Q32 is only about 8 watts, as was previously mentioned, and this is the maximum power that is dissipated in transistor Q32 under any conditions.

Figure 4A:
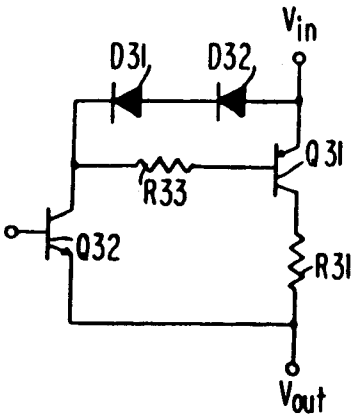
FIGS. 4*a*, 4*b*, 4*c*, and 4*d* illustrate alternative arrangements of output stage circuitry which are useful in a series pass voltage regulator in accordance with the invention.
Figure 4B:
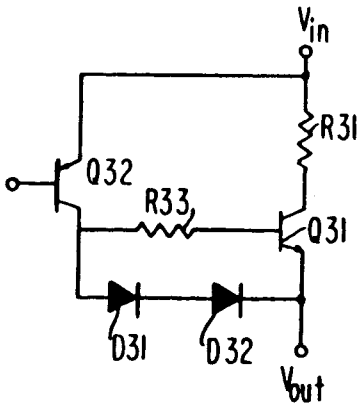
Figure 4C:
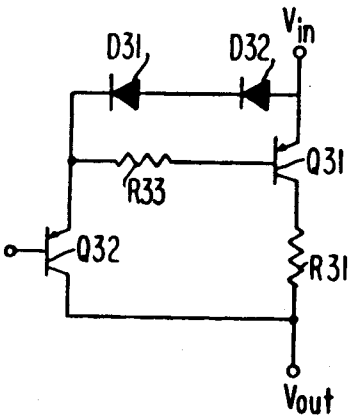
Figure 4D:
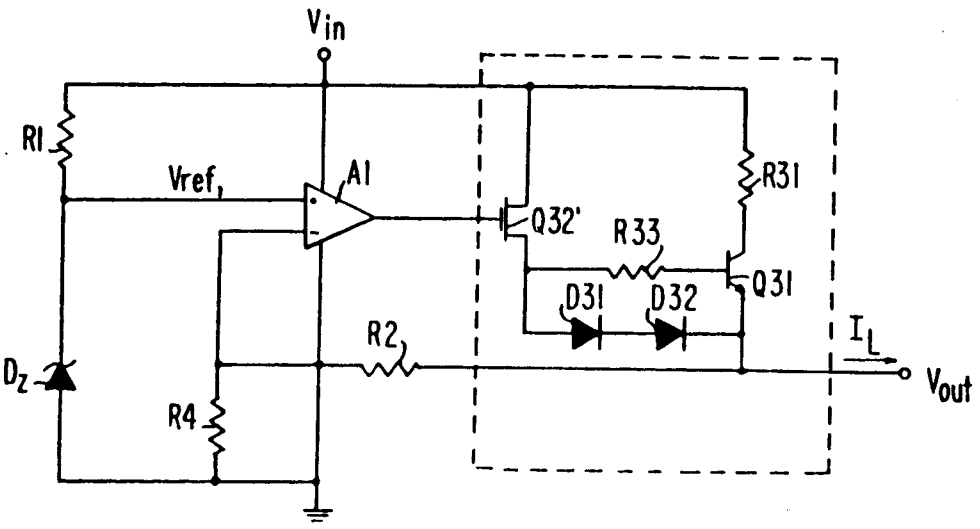

Although a specific output stage circuit arrangement has been shown and described, many alternative arrangements may be employed to practice the invention. Some obvious alternatives are illustrated in FIGS. 4*a*, 4*b* and 4*c*, in which various combinations of PNP and NPN transistors are employed. Further, transistor Q32 could be replaced with a field effect transistor of either a junction or insulated gate type, as is illustrated in FIG. 4*d*. As another alternative, one or more additional series combinations of a resistor and a transistor output impedance could be placed in parallel with the series combination of resistor R31 and transistor Q31. Each such series combination would have the input of the transistor electrically connected to the output impedance of transistor Q32, either directly or through protective current limiting means such as a resistor.

I claim:

1. A linear, series pass voltage regulator including an input for receiving an unregulated first DC voltage and including an output for supplying a variable load current at a regulated second DC voltage having a predetermined magnitude, said voltage regulator comprising:

a. a variable impedance output stage electrically connected between the input and the output for carrying the load current; and b. control circuitry electrically connected to the voltage regulator input and to the output stage for comparing the second DC voltage to a reference voltage and for producing a control signal for controlling the impedance of the output stage to effect maintenance of the second DC voltage at the predetermined magnitude despite variations of the first DC voltage and the load current;

characterized in that the output stage comprises:

(1) a first impedance comprising a series combination of a resistor and a first semiconductor device output impedance electrically connected between the input and the output of the regulator, said first semiconductor device having an input for receiving said control signal to effect variation of the device output impedance;

(2) a second impedance comprising a series combination of a second semiconductor device output impedance and voltage-dropping semiconductor means electrically connected between the input and the output of the regulator, said second semiconductor device having an input for receiving said control signal to effect variation of the device output impedance, said input of said second semiconductor device being electrically connected to the control circuitry for receiving the control signal; and (3) resistive coupling means electrically connecting a junction between the voltage-dropping semiconductor junction means and the output impedance of the second semiconductor device to the input of the first semiconductor device for coupling the control signal to said input of said first semiconductor device, said control signal effecting, in sequence, a gradual decrease in the first impedance from a high value to a low value as the load current increases to a predetermined magnitude, while the second impedance remains at a value which is much higher than the value of the first impedance, followed by a gradual decrease in the second impedance from said higher value as the load current increases above said predetermined magnitude, while the first impedance remains at said low value.

2. A voltage regulator as in claim 1 where the first semiconductor device comprises a junction device and where said device operates in saturation at the low value of the first impedance.

3. A voltage regulator as in claim 1 or 2 where the coupling means comprises a resistor.

4. A voltage regulator as in claim 1 or 2 where the voltage-dropping semiconductor junction means comprises at least one semiconductor diode.

5. A voltage regulator as in claim 1 or 2 where the first semiconductor device comprises a junction transistor and the second semiconductor device comprises an insulated gate field effect transistor.

6. A voltage regulator as in claim 1 or 2 where both the first and second semiconductor devices comprise junction transistors.

* * * * *